United States Patent [19]

Greene

[11] Patent Number: 4,773,533

[45] Date of Patent: Sep. 27, 1988

[54] FOLDABLE GARMENT CONTAINER

[75] Inventor: Irwin R. Greene, Lincolnwood, Ill.

[73] Assignee: Sears, Roebuck and Co., Chicago, Ill.

[21] Appl. No.: 50,867

[22] Filed: May 18, 1987

[51] Int. Cl.[4] ..... B65D 85/18

[52] U.S. Cl. ..... 206/288; 206/279; 206/290; 229/16 R; 229/183; 229/193

[58] Field of Search ..... 206/278, 279, 280, 284, 206/288, 289, 290, 291, 295, 299; 229/183, 193

[56] References Cited

U.S. PATENT DOCUMENTS

| | | | |
|---|---|---|---|
| 3,259,225 | 7/1966 | Brittingham | 206/289 |
| 3,565,242 | 2/1971 | Konkoli | 206/290 |
| 4,060,169 | 11/1977 | Hildebrand et al. | 206/289 |
| 4,085,842 | 4/1978 | Beck | 206/289 |
| 4,098,399 | 7/1978 | Bethune et al. | 206/288 |
| 4,119,197 | 10/1978 | Pilz | 206/289 X |
| 4,158,406 | 6/1979 | Feder | 206/290 X |
| 4,300,687 | 11/1981 | Gardner et al. | 206/288 X |
| 4,318,472 | 3/1982 | Nauheimer et al. | 206/289 X |
| 4,342,389 | 8/1982 | Bethune et al. | 206/288 |
| 4,402,404 | 9/1983 | Nauheimer | 206/279 |
| 4,416,371 | 11/1983 | Nauheimer | 206/289 |

*Primary Examiner*—William Price
*Assistant Examiner*—Sue A. Weaver
*Attorney, Agent, or Firm*—Wood, Dalton, Phillips, Mason & Rowe

[57] ABSTRACT

A foldable garment container formed of sheet material comprising a single blank. The container is defined by a bottom wall, a pair of side walls, a pair of end walls, and a top wall and is of a size and configuration to hold at least one garment disposed on a garment hanger. At least one of the end walls has top and bottom flaps. The container also includes a hanger retainer integral therewith proximate an inner surface of the one of the end walls. At least one of the top and bottom flaps is die cut to form the hanger retainer as an integral hanger support. The container includes a fold line in closely spaced relation to the one of the end walls along which the integral hanger support is foldably joined to the remainder of the one of the top and bottom flaps. Additionally, the garment container includes integral retaining members for maintaining the integral hanger support in generally parallel relation to the one of the end walls.

19 Claims, 2 Drawing Sheets

FOLDABLE GARMENT CONTAINER

FIELD OF THE INVENTION

The present invention is generally related to containers and, more particularly, to a foldable garment container which is formed of sheet material blanks.

BACKGROUND OF THE INVENTION

As will be appreciated by those in the garment industry, many garments are displayed on garment hangers. This is done, of course, because of the recognized advantages to a consumer due to the opportunity to inspect a garment which is displayed on a hanger much more thoroughly than with a folded garment. When so displayed, the hang, shape, pattern, matching and other construction features can be closely examined.

However, if a garment is to be displayed for sale on a hanger, it should have a pleasing appearance. This means that the garment cannot be wrinkled or excessively creased by folding when it is shipped from the point of manufacture to the point of sale unless the retailer first irons the garment prior to displaying it with the required uncreased appearance. As will be appreciated, this is a time-consuming step that is almost a practical impossibility for major retailers.

For this reason, it has become increasingly popular for various garments such as jackets, shirts, and blouses to be shipped to the retailer with the garment already placed on a conventional garment hanger. Thus, of course, the hanger will have a loop formed thereon and protruding from the neck of the garment. In order to accomplish this objective, it is important for the hanger to be anchored in place once the garment on the hanger is positioned within the container.

Naturally, it is important for the container to be capable of normal handling. This means that the hanger support within the container must be capable of supporting the weight of the garments and hangers as well as withstanding the normal degree of abuse that may be expected during shipment and handling. Furthermore, the container should ideally support the garments in a manner that eliminates the possibility of creasing no matter what the orientation of the container.

Another important criteria is the cost of a foldable garment container. Preferably, the container is integrally formed of paperboard products in an inexpensive manner which allows the container to be disposable. In this way, the container will not utilize expensive metal hanger bars as a part of the construction.

Among the many attempts to address these problems are those disclosed in Nauheimer U.S. Pat. No. 4,416,371, Nauheimer et al U.S. Pat. No. 4,318,472, Gardner et al U.S. Pat. No. 4,300,687 Hildebrand et al U.S. Pat. No. 4,060,169, and Brittingham U.S. Pat. No. 3,259,229. These patents all disclose cardboard shipping containers having integral cardboard hanger supports and, in particular, the Nauheimer '371 patent accomplishes this with a hollow double-end wall structure having a slot, the Nauheimer et al '472 patent accomplishes this by having a pair of slots through a hollow double-end wall structure whereby an aperture in a separate lid locks the hook of the hangers in position, the Gardner et al '687 patent accomplishes this by forming tab panels from the bottom panels, the Hildebrand '169 patent accomplishes this by a hollow double-end wall structure having a hanger receiving slot, and the Brittingham '229 patent accomplishes this by a hollow double-end wall structure having spaced apertures corresponding to the spacing of a hook portion of a garment hanger. Unfortunately, none of these patents disclose a completely satisfactory form of foldable garment container, nor do other attempts disclosed in Nauheimer U.S. Pat. No. 4,402,404, Feder U.S. Pat. No. 4,158,406, and Pilz U.S. Pat. No. 4,119,197.

The present invention is directed to overcoming the above-stated problems and accomplishing the stated objects by providing a foldable garment container formed of sheet material blanks.

SUMMARY OF THE INVENTION

Accordingly, the present invention is directed to a garment container comprising container means defined by a plurality of walls. The walls include a bottom wall, a pair of side walls, a pair of end walls, and a top wall. With this construction, the container means is of a size and configuration to hold at least one garment disposed on a garment hanger.

The garment container is formed such that at least one of the end walls has a top flap and a bottom flap and hanger retaining means integral with the container means proximate an inner surface of the one of the end walls. The hanger retaining means is formed by die cutting at least one of the top and bottom flaps to define an integral hanger support. In this connection, the integral hanger support is foldably joined to the remainder of the one of the top and bottom flaps along a fold line in closely spaced relation to the one of the end walls.

As will be appreciated, the garment container includes means for retaining the integral hanger support in generally parallel relation to the one of the end walls. In the exemplary embodiment, the retaining means includes a tab integrally associated with the integral hanger support at a point remote from the fold line. Preferably, the retaining means also includes a tab-receiving opening in the container means in closely spaced relation to the one of the end walls.

Still other features of the present invention include the integral hanger support being disposed at a point generally intermediate the side walls of the container means and being of a length sufficient to extend between the top and bottom flaps in a direction generally transversely of the top and bottom walls. The integral hanger support is also advantageously die cut along parallel cut lines extending in a direction generally transversely of the end wall to a point spaced from a fold line between the one of the end walls and the one of the top and bottom flaps. Furthermore, the integral hanger suport preferably includes a pair of fold lines extending in generally parallel relation to the cut lines to form a pair of strengthening flanges facing the one of the end walls and extending substantially entirely between the top and bottom flaps.

In the preferred embodiment, the hanger retaining means is formed by die cutting both of the top and bottom flaps of the one of the end walls to define cooperating integral hanger supports. The integral hanger supports are folded to extend in opposite directions in nested contacting relation to provide hanger-supporting reinforcement and, preferably, each of the end walls has a top flap and a bottom flap. With this construction, the garment container can include hanger supports integral with the container means proximate an inner surface of each of the end walls and formed by die cutting the respective top and bottom flaps.

In another aspect, the present invention is directed to a foldable container formed of at least one blank of sheet material. The blank includes bottom wall portions each having a side wall foldably joined thereto and having a top wall portion foldably joined to the side wall. The blank also includes end wall structures each having an end wall with a top flap foldably joined to a top edge thereof and a bottom flap foldably joined to a bottom edge thereof. With this construction, the end walls are foldably joined to one end of the respective side walls.

Also, the blank is formed such that the side walls are foldably joined to the bottom wall portions along fold lines generally colinear with first fold lines along which the bottom flaps are foldably joined to the end walls. Further, the blank is formed such that the top wall portions are foldably joined to the side walls along fold lines generally colinear with first fold lines along which the top flaps are foldably joined to the end walls.

In this connection, the blank is further formed such that at least one of the respective top and bottom flaps is die cut to form an integral hanger support extending generally transversely of the corresponding end wall. The integral hanger support is foldably joined to the remainder of the one of the respective top and bottom flaps along a second fold line in closely spaced parallel relation to the first fold line along which the one of the respective top and bottom flaps is foldably joined to the corresponding end wall. Additionally, the foldable container includes means for retaining the integral hanger support in generally parallel relation to the corresponding end wall after folding the integral hanger support along the second fold line and also includes means for securing the blank together in the form of a generally box-like structure.

In an exemplary embodiment, the bottom wall portions, side walls, end walls and top wall portions are generally rectangular. The blank is then foldable to form a generally rectangular box-like structure with each of the end walls being foldably joined to the corresponding one of the side walls along a corner fold line to form one corner of the box-like structure and one of the end walls being foldably joined to the other one of the side walls along another corner fold line to form still another corner of the box-like structure. Furthermore, the other of the end walls has an edge directly opposite the corner fold line and in parallel relation thereto which is secured to a free edge of the opposite side wall to form the first corner of the boxlike structure.

Still additional details include the other of the end walls having a tab projecting from the opposite edge thereof. The tab laps the free edge of the opposite side wall at the corresponding edge thereof. With this construction, the tab is secured to the opposite side wall near the free edge thereof.

Preferably, the bottom wall portions are disposed in partially overlapping relation when the tab is secured to the opposite side walls at the free edge thereof. The bottom wall portions also advantageously include an overlap extending entirely between the end walls at a point intermediate the side walls. In this connection, the overlap is of a width preferably generally corresponding to the width of the integral hanger support, and the bottom wall portions are secured together along the overlap to form an integral bottom wall.

Still further, the integral hanger support is preferably disposed at a point generally intermediate the side walls of the box-like structure and the bottom flaps are folded to lie upon the integral bottom wall. With this construction, a tab integrally associated with the integral hanger support at a point remote from the fold line can be placed in a tab-receiving opening in the bottom of the boxlike structure in closely spaced relation to the one of the end walls.

As before, the hanger retaining means is preferably formed by die cutting top and bottom flaps on each of the end wall structures to define cooperating integral hanger supports. The respective integral hanger supports are folded to extend in opposite directions in nested contacting relation to provide hanger-supporting reinforcement proximate an inner surface of each of the end walls, and the retaining means includes a tab integrally associated with the one of the integral hanger supports formed by die cutting the top flaps which are folded over the ones of the integral hanger supports formed by die cutting the bottom flaps. With this construction, tab-receiving openings in the innermost one of the overlapping bottom wall portions receive the respective tabs intermediate the side walls in closely spaced relation to the end walls in the area of the overlap.

Other objects, advantages and features of the present invention will become apparent from a consideration of the following specification taken in conjunction with the accompanying drawings.

DETAILED DESCRIPTION OF THE PREFERRED EMBODIMENT

Figure 1:
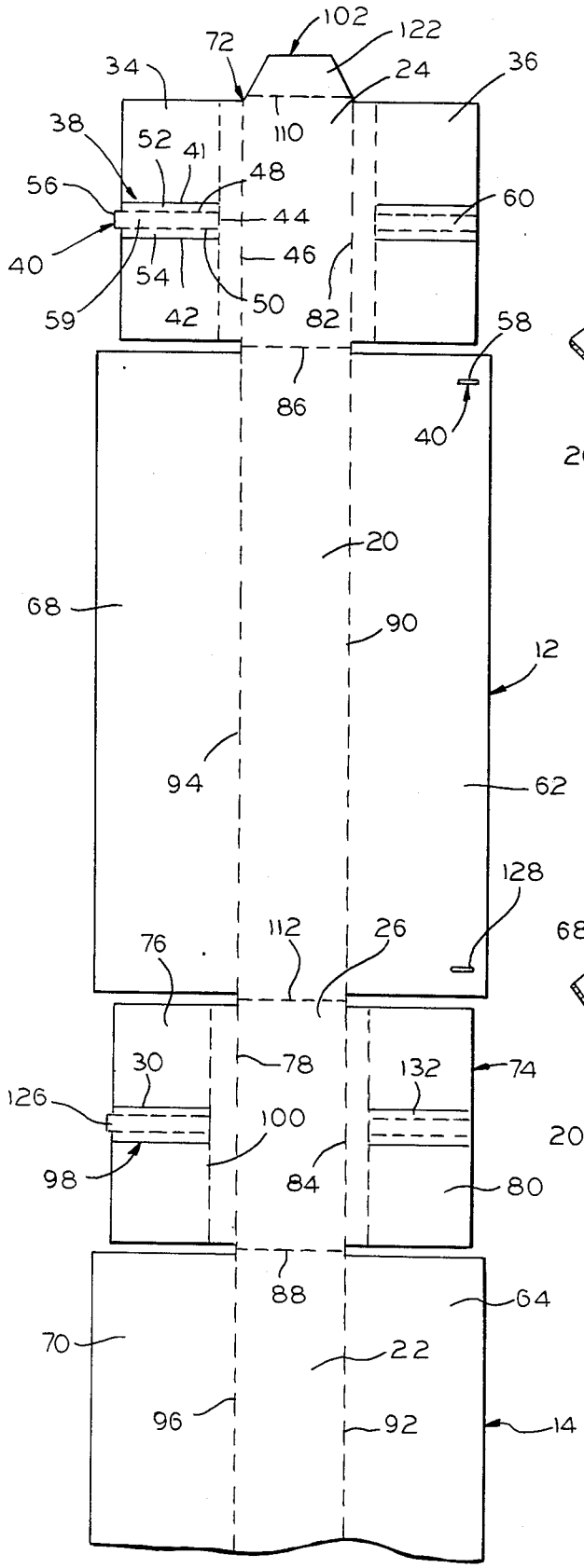
FIG. 1 is a top plan view of a single sheet material blank for a foldable garment container in accordance with the present invention.

An examplary embodiment of a foldable garment container formed of a single sheet material blank is illustrated in FIGS. 1 through 6. The garment container 10 includes a blank formed into a pair of substantially identical blank portions 12,14 of a sheet material such as paperboard adapted to be formed into container means 16. The container means 16 is defined by a plurality of walls including a bottom wall 18, a pair of side walls 20 and 22, a pair of end walls 24 and 26, and a top wall 28, and is of a size and configuration to hold at least one garment 30 disposed on a garment hanger 32 (see FIG. 6). The garment container 10 also includes a top flap 34 and a bottom flap 36 on at least one of the end walls 24,26 and hanger retaining means 38 integral with the container means 16 proximate an inner surface of the one of the end walls such as 24. With this construction, the hanger retaining means 38 is formed by die cutting at least one of the top and bottom flaps 34,36 to define an integral hanger support.

Figure 2:
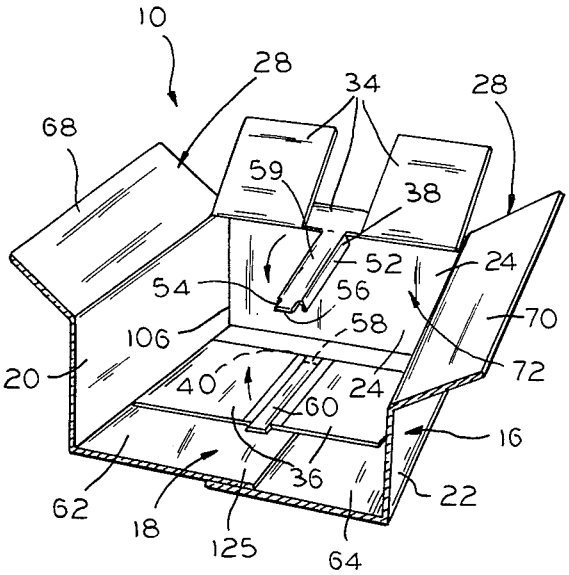
FIG. 2 is a partial perspective view of a foldable garment container during initial assembly from the sheet material blank of FIG. 1.
Figure 3:
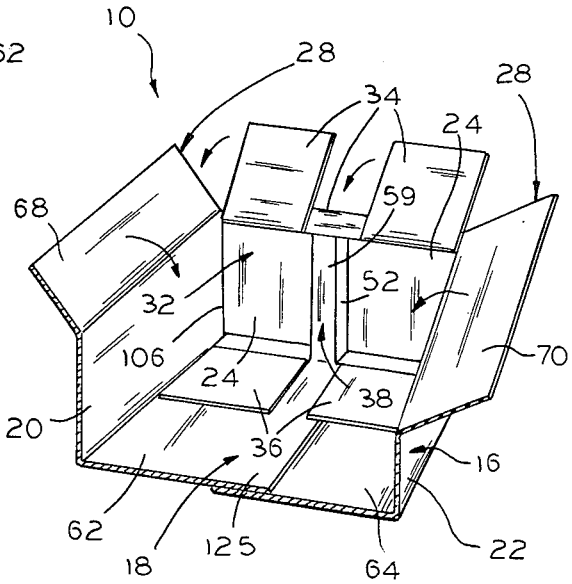
FIG. 3 is a partial perspective view of a foldable garment container after complete assembly from the sheet material blank of FIG. 1.

As will be appreciated by referring to FIGS. 2 and 3, the hanger retaining means 38 is foldably joined to the remainder of the one of the top and bottom flaps such as 34 along a fold lie in closely spaced relation to the one of the end walls 24. It will also be appreciated by referring to FIG. 2 that the garment container 10 includes means generally designated 40 (and shown in phantom lines) for retaining the hanger retaining means 38 in generally parallel relation to the one of the end walls 24. Furthermore, as shown, the hanger retaining means 38 is disposed at a point generally intermediate the side walls 20 and 22 of the container means 16 and is of a length sufficient to extend between the top and bottom flaps 34 and 36 in a direction generally transversely of the top and bottom walls 18 and 28.

As best shown in FIG. 1, the hanger retaining means 38 is die cut along parallel cut lines 41 and 42 extending in a direction generally transversely of the end wall 24 to a second fold line 44 for the integral hanger support 38 spaced from a first fold line 46 between the one of the end walls 24 and the one of the top and bottom flaps 34. Moreover, the hanger retaining means 38 preferaly includes a pair of fold lines 48 and 50 extending in generally parallel relation to the cut lines 41 and 42 to form a pair of strengthening flanges 52 and 54 facing the one of the end walls 24 and extending substantially entirely between the top and bottom flaps 34 and 36 (compare FIGS. 3 and 5).

Referring now to FIGS. 1 and 2, the retaining means 40 includes a tab 56 integrally associated with the hanger retaining means 38 at a point remote from the second fold line 44. Also, the retaining means 40 includes a tabreceiving opening 58 in the container means 16 in closely spaced relation to the one of the end walls 24 so as to maintain the hanger retaining means 38 in parallel relation to the inner surface thereof.

In the preferred embodiment, the hanger retaining means 38 is formed by die cutting both of the top and bottom flaps 34 and 36 of the one of the end walls 24 to define cooperating integral hanger supports 59 and 60. The cooperating integral hanger supports 59 and 60 are folded to extend in opposite directions in nested contacting relation (see FIGS. 2, 3 and 5) to provide hanger-supporting reinforcment and, furthermore, each of the end walls 24 and 26 preferably has a top flap such as 34 and a bottom flap such as 36. With this construction, the garment container 10 can be provided with essentially identical integral hanger supports such as 59 and 60 proximate an inner surface of each of the end walls 24 and 26 where the hanger supports such as 59 and 60 are formed by die cutting the respective top and bottom flaps such as 34 and 36.

Referring specifically to FIG. 1, the foldable garment container 10 can be clearly seen as entirely formed of a single sheet material blank formed into the pair of substantially identical blank portions 12 and 14. The blank portions 12 and 14 each include bottom wall portions 62 and 64, respectively, having the side walls 20 and 22 foldably joined thereto and top wall portions 68 and 70, respectively, foldably joined to the side walls 20 and 22. The blank portions 12 and 14 also each include end wall structures, generally designated 72 and 74, respectively, including the end walls 24 and 26 with top flaps 34 and 76, respectively, foldably joined to top edges or fold lines 46 and 78 and bottom flaps 36 and 80, respectively, foldably joined to bottom edges or fold lines 82 and 84 thereof. Also as shown, the end walls 24 and 26 are foldably joined, as at fold lines 86 and 88, respectively, to one end of the side walls 20 and 22.

Still referring to FIG. 1, the blank portions 12 and 14 are each also formed such that the side walls 20 and 22 are foldably joined to the bottom wall portions 62 and 64 along fold lines 90 and 92 generally colinear with the first fold lines or bottom edges 82 and 84 along which the bottom flaps 36 and 80 are foldably joined to the end walls 24 and 26, respectively. Additionally, the blank portions 12 and 14 are each formed such that the top wall portions 68 and 70 are foldably joined to the side walls 20 and 22 along fold lines 94 and 96 generally colinear with the first fold lines or bottom edges 46 and 78 along which the top flaps 34 and 76 are foldably joined to the end walls 24 and 26, respectively.

As will be appreciated, the blank portions 12 and 14 each further are formed such that at least one of the respective top and bottom flaps 34,76 and 36,74 are die cut to form hanger retaining means 38 and 98. The hanger retaining means 38 and 98 extend generally transversely of end walls 24 and 26, respectively, and are foldably joined to the remainder of the ones of the respective top and bottom flaps such as 34,76 and 36,74 along respective second fold lines 44 and 100 in closely spaced parallel relation to the respective first fold lines 46 and 78 along which the respective ones of the top and bottom flaps such as 34,76 are foldably joined to the respective end walls 24 and 26. In the embodiment illustrated, the hanger retaining means 38 and 98 are die cut from the top flaps 34 and 76, respectively, and means 102 is provided for securing one of the blank portions 12 to the other of the blank portions 14 in the form of a generally box-like structure (see, also, FIGS. 5 and 6).

As can be seen from the drawings, the bottom wall portions 62 and 64, side walls 20 and 22, end walls 24 and 26 and top wall portions 68 and 70 are generally rectangular. The blank portions 12 and 14 are each foldable to form the generally rectangular box-like structure illustrated in FIGS. 2 through 4 in cooperation with one another and each of the end walls 24 and 26 is foldably joined to the corresponding one of the side walls 20 and 22 along the corner fold lines 86 and 88 to form one corner 106 and 108, respectively, of the box-like structure, with the end wall 26 also being foldably joined to the opposite one of the side walls 20 along the corner fold line 112 to form another of the corners 114. Furthermore, the end wall 24 has an edge 110 directly opposite the corner fold line 86 and in parallel relation thereto, and edge 110 of the blank portion 12 is secured to the edge 116 of the side wall 22 to form the final one of the corners 118 of the box-like structure.

Figure 6:
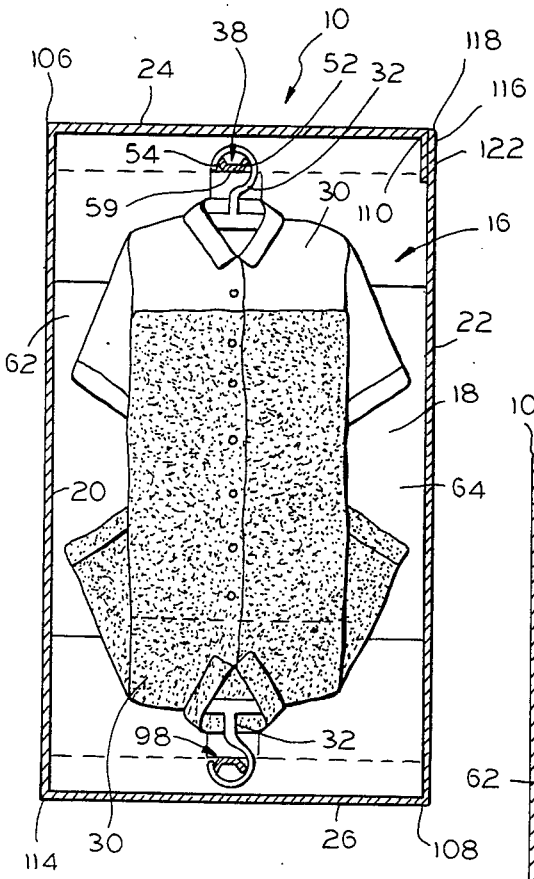
FIG. 6 is a cross-sectional view similar to FIG. 5 illustrating garment packing in the foldable garment container.
Figure 5:
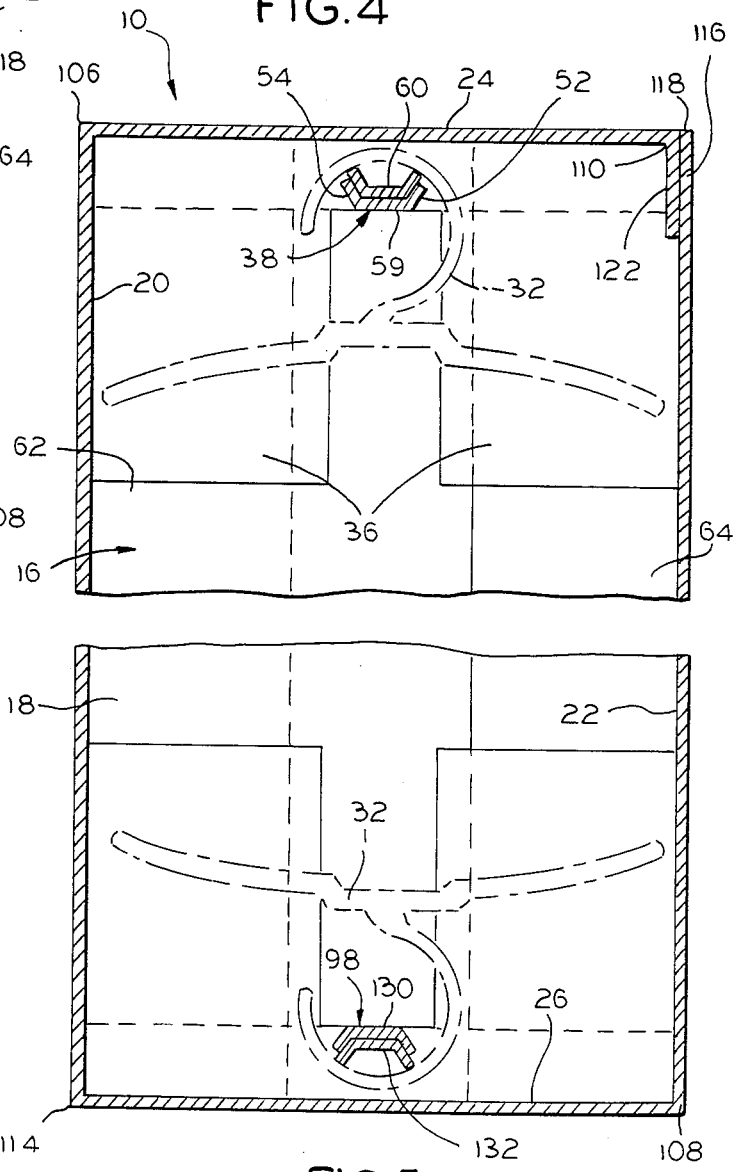
FIG. 5 is a cross-sectional view taken on the line 5—5 of FIG. 4 illustrating cooperation of hangers with the integral hanger supports.

As will be appreciated by referring to FIGS. 1, 5 and 6, the end wall 24 includes a tab 122 projecting from the edge 110 thereof. The tab 122 laps the side wall 22 of the other of the blank portions 14 at the edge 116 thereof. With this construction, the tab 122 is secured to the side wall 22 of the other of the blank portions 14 near the edge 116 thereof.

Figure 4:
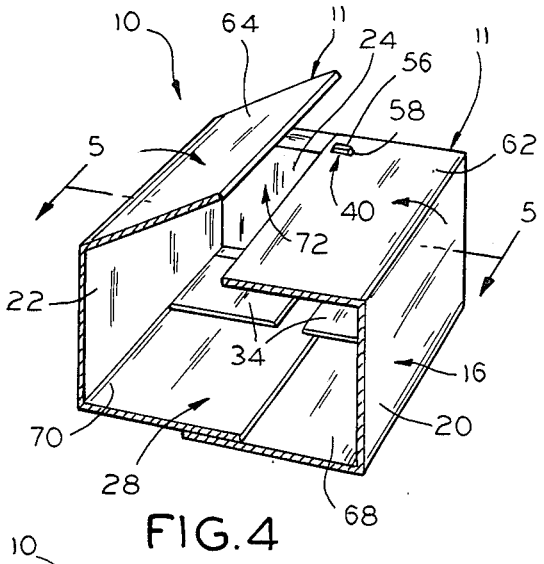
FIG. 4 is a partial perspective view of an inverted foldable garment container partially disassembled to illustrate the manner of securing the integral hanger supports therein.

Referring specifically to FIGS. 2 through 4, the bottom wall portions 62 and 64 are disposed in overlapping relation when the edge 110 of the end wall 24 is secured to the side wall 22 at the edge 116 thereof. The bottom wall portions 62 and 64 include an overlap as at 125 extending entirely between the end walls 24 and 26 intermediate the side walls 20 and 22, and the bottom wall portions 62 and 64 are secured together along the overlap 125 by means of an adhesive, staples, or other conventional fasteners to form the integral bottom wall 18. As will be appreciated, the overlap 125 is of a width generally corresponding to the width of the integral hanger retaining means 38 and 98, and the bottom flaps 36 and 80 are folded to lie upon the integral bottom wall 18.

As previously discussed, the hanger retaining means 38 and 98 are disposed at respective points generally intermediate the side walls 20 and 22 of the box-like structure and are of a length sufficient to extend between the respective top and bottom flaps 34,36 and 76,80. Also, as previously discussed, the retaining means includes tabs 56 and 126 integrally associated with the hanger retaining means 38 and 98 at respective points remote from the fold lines 44 and 100 and also includes tab-receiving openings 58 and 128 in the box-like structure in closely spaced relation to the respective ones of the end walls 24 and 26.

Preferably, the hanger retaining means is formed by die cutting both of the respective top and bottom flaps 34,36 and 76,80 of the respective ones of the end wall structures 72 and 74 to define cooperating integral hanger supports 59,60 and 130,132. The integral hanger supports 59,60 and 130,132 are folded to extend in opposite directions in nested contacting relation (see FIGS. 2, 3 and 5) to provide hanger-supporting reinforcement. As shown in the drawings, the cooperating integral hanger supports 59,60 and 130,132 are proximate inner surfaces of each of the end walls 24 and 26 and are formed by die cutting the respective top and bottom flaps 34,36 and 76,80 of the respective end wall structures 72 and 74.

As will be clear from FIGS. 1 and 2, the retaining means preferably includes tabs 56 and 126 integrally associated with the respective ones of the integral hanger supports 59 and 130 formed by die cutting the top flaps 34 and 76, respectively. These integral hanger supports 59 and 130 are then folded over the ones of the integral hanger supports 60 and 132 formed by die cutting the bottom flaps 36 and 80, respectively. Since the tab-receiving openings 58 and 128 are preferably in the innermost one of the overlapping bottom wall portions 62 and 64, i.e. bottom wall portion 62, intermediate the side walls 20 and 22 in the area of the overlap 125, the tabs 56 and 126 can then be inserted into the tab-receiving openings 58 and 128 to complete assembly.

With the foldable garment container 10 of the invention, it is possible to ship blouses and the like on hangers in a manner capable of avoiding wrinkles caused by shifting of the garments within the container at times when the container is not maintained in a particular orientation. Moreover, since the container can be formed of sheet material such as cardboard, and utilizes no separate parts such as metal hanger bars or the like, it is inexpensive to manufacture and can be used as a disposable.

When the foldable garment container has been assembled, it can be loaded with garments on hangers in alternating fashion. More specifically, a garment on a hanger is placed on the hanger support at one end of the container after which a garment on a hanger is placed on the hanger support at the other end of the container, and this is continued until the container is loaded. By so doing, the friction between the garments or polyethylene bags over the garments maintains them in a desired position regardless of the orientation of the container.

While in the foregoing there has been set forth a preferred embodiment of the invention, it is to be understood that the invention is only to be limited by the spirit and scope of the appended claims.

I claim;

1. A garment container, comprising:

container means defined by a plurality of walls, said walls including a bottom wall, a pair of side walls, a pair of end walls, and a top wall, said container means being of a size and configuration to hold at least one garment disposed on a garment hanger;

at least one of said end walls having a top flap and a bottom flap; and hanger retaining means integral with said container means proximate an inner surface of said one of said end walls;

said hanger retaining means being formed by die cutting both of said top and bottom flaps of said one of said end walls to define cooperating integral hanger supports, said cooperating integral hanger supports being foldably joined to the remainder of said top and bottom flaps along a fold line in closely spaced relation to said one of said end walls so as to extend in opposite directions in nested contacting relation to provide hanger-supporting reinforcement, and including means for retaining said cooperating integral hanger supports in generally parallel relation to said one of said end walls.

2. The garment container as defined by claim 1 wherein said cooperating integral hanger supports are disposed at a point generally intermediate said side walls of said container means, said cooperating integral hanger supports being of a length sufficient to extend between said top and bottom flaps in a direction generally transversely of said top and bottom walls.

3. The garment container as defined by claim 1 wherein said cooperating integral hanger supports are die cut along parallel cut lines extending in a direction generally transversely of said end wall, said cooperating integral hanger supports being die cut to a point spaced from fold lines between said one of said end walls and the respective ones of said top and bottom flaps.

4. The garment container as defined by claim 3 wherein each of said cooperating integral hanger supports includes a pair of fold lines extending in generally parallel relation to said cut lines to form a pair of strengthening flanges, said strengthening flanges facing said one of said end walls and extending substantially entirely between said top and bottom flaps.

5. The garment container as defined by claim 1 wherein said retaining means includes a tab integrally associated with at least one of said cooperating integral hanger supports at a point remote from the corresponding one of said fold lines, said retaining means also including a tab-receiving opening in said container means in closely spaced relation to said one of said end walls.

6. The garment container as defined by claim 1 wherein each of said end walls has a top flap and a bottom flap, said garment container including hanger supports integral with said container means proximate an inner surface of each of said end walls, said hanger supports being formed by die cutting said respective top and bottom flaps.

7. A foldable container formed of sheet material, comprising:

a single blank including a pair of substantially identical blank portions of said sheet material, each of said blank portions including a bottom wall portion having a side wall foldably joined thereto and having a top wall portion foldably joined to said side wall, each of said blank portions also including an end wall structure having an end wall with a top flap foldably joined to a top edge thereof and a bottom flap foldably joined to a bottom edge thereof, said end wall being foldably joined to one end of said side wall;

each of said blank portions also being formed such that said side wall is foldably joined to said bottom wall portion along a fold line generally colinear with a first fold line along which said bottom flap is foldably joined to said end wall, each of said blank portions also being formed such that said top wall portion is foldably joined to said side wall along a fold line generally colinear with a first fold line along which said top flap is foldably joined to said end wall;

at least one of said blank portions further being formed such that both of said top and bottom flaps are die cut to form cooperating integral hanger supports, said cooperating integral hanger supports extending generally transversely of said end wall, said cooperating integral hanger supports being foldably joined to the remainder of the respective one of said top and bottom flaps along second fold lines in closely spaced parallel relation to said first fold lines along which said top and bottom flaps are foldably joined to said end wall so as to extend in opposite directions in nested contacting relation to provide hanger-supporting reinforcement, and including means for retaining said cooperating integral hanger supports in generally parallel relation to said end wall after folding said cooperating integral hanger supports along said second fold lines; and means for securing one of said blank portions to the other of said blank portions in the form of a generally box-like structure.

8. The foldable container as defined by claim 7 wherein said bottom wall portions, side walls, end walls and top wall portions are generally rectangular, each of said blank portions being foldable to form a generally rectangular box-like structure in cooperation with the other of said blanks.

9. The foldable container as defined by claim 8 wherein each of said end walls is foldably joined to the corresponding one of said side walls along a corner fold line to form one corner of said box-like structure, one of said end walls having an edge directly opposite the corresponding one of said corner fold lines and in parallel relation thereto, said one of said end walls having said opposite edge secured to a corresponding edge of said side wall of the other of said blank portions to form another corner of said box-like structure.

10. The foldable container as defined by claim 9 wherein said one of said end walls includes a tab projecting from said opposite edge thereof, said tab lapping said side wall of the other of said blank portions at said corresponding edge thereof, said tab being secured to said side wall of the other of said blanks near said corresponding edge thereof.

11. The foldable container as defined by claim 9 wherein said bottom wall portions are disposed in overlapping relation when said opposite edge of said one of said end walls is secured to said side wall of the other of said blank portions at said corresponding edge thereof, said bottom wall portions including an overlap extending entirely between said end walls at a point intermediate said side walls.

12. The foldable container as defined by claim 11 wherein said bottom wall portions are secured together along said overlap to form an integral bottom wall, said overlap being of a width generally corresponding to the width of said cooperating integral hanger supports, said bottom flaps being folded to lie upon said integral bottom wall.

13. The foldable container as defined by claim 12, wherein said cooperating integral hanger supports are disposed at a point generally intermediate said side walls of said box-like structure, said cooperating integral hanger supports being of a length sufficient to extend between said top and bottom flaps.

14. The foldable container as defined by claim 12, wherein said cooperating integral hanger supports are die cut along parallel cut lines extending in a direction generally transversely of said end wall, said cooperating integral hanger supports being die cut to a point spaced from said first fold lines between said one of said end walls and the respective ones of said top and bottom flaps.

15. The foldable container as defined by claim 14 wherein said cooperating integral hanger supports each include a pair of fold lines extending in generally parallel relation to said cut lines to form a pair of strengthening flanges, said strengthening flanges facing said one of said end walls and extending substantially entirely between said top and bottom flaps.

16. The foldable container as defined by claim 12 wherein said retaining means includes a tab integrally associated with at least one of said cooperating integral hanger supports at a point remote from the corresponding one of said second fold lines, said retaining means also including a tab-receiving opening in said box-like structure in closely spaced relation to said one of said end walls.

17. The foldable container as defined by claim 16 including cooperating integral hanger supports proximate an inner surface of each of said end walls, each of said cooperating integral hanger supports being formed by die cutting the respective ones of said top and bottom flaps of said end wall structures.

18. The foldable container as defined by claim 17 wherein said retaining means includes a tab integrally associated with the ones of said cooperating integral hanger supports formed by die cutting said top flaps, the ones of said cooperating integral hanger supports formed by die cutting said top flaps being folded over the ones of said cooperating integral hanger supports formed by die cutting said bottom flaps.

19. The foldable container as defined by claim 18 wherein said retaining means also includes tab-receiving openings in the innermost one of said overlapping bottom wall portions, said tab-receiving openings being disposed intermediate said side walls in closely spaced relation to said end walls in the area of said overlap.

* * * * *